US005865407A

United States Patent [19]

Effa

[11] Patent Number: 5,865,407

[45] Date of Patent: Feb. 2, 1999

[54] COVERS

[76] Inventor: Gerald I. Effa, 1 E. Camelback Rd., Suite 550, Phoenix, Ariz. 85012

[21] Appl. No.: 627,687

[22] Filed: Apr. 2, 1996

Related U.S. Application Data

[62] Division of Ser. No. 65,815, May 21, 1993, Pat. No. 5,462, 103.

[51] Int. Cl.[6] ..... B65B 67/00

[52] U.S. Cl. ..... 248/164; 248/97; 220/9.4; 220/495.01; 220/404

[58] Field of Search ..... 248/164, 97, 99, 248/101, 166; 160/399, 401, 402; 220/9.4, 495.01, 404

[56] References Cited

U.S. PATENT DOCUMENTS

| | | | |
|---|---|---|---|
| 1,237,914 | 8/1917 | Kunath . | |
| 1,353,866 | 9/1920 | Vondree . | |
| 1,421,628 | 7/1922 | Watkins . | |
| 2,092,969 | 9/1937 | Gustafson et al. | 220/65 |
| 2,375,819 | 5/1945 | Reid | 155/150 |
| 2,484,382 | 10/1949 | Kennedy | 248/166 |
| 3,022,605 | 2/1962 | Reynolds | 47/58 |
| 3,227,137 | 1/1966 | Goldman et al. | 119/1 |
| 3,368,601 | 2/1968 | Gantert-Merz | 150/52 |
| 3,502,291 | 3/1970 | Ackerman et al. | 248/97 |
| 3,604,677 | 9/1971 | Gits | 248/97 |
| 4,579,066 | 4/1986 | Zeigler | 108/157 |
| 4,580,750 | 4/1986 | Spellman | 248/164 |
| 4,613,104 | 9/1986 | Garrott | 248/97 |
| 4,708,183 | 11/1987 | Figueroa | 150/52 |
| 5,100,087 | 3/1992 | Ashby | 248/97 |
| 5,165,633 | 11/1992 | Effa et al. | 248/164 |
| 5,192,092 | 3/1993 | DiBenedetto | 280/654 |

FOREIGN PATENT DOCUMENTS

| | | | |
|---|---|---|---|
| 609425 | 11/1960 | Canada . | |
| 159309 | 3/1984 | European Pat. Off. | 220/404 |
| 8587007.9 | 10/1985 | European Pat. Off. . | |
| 828647 | 2/1960 | United Kingdom . | |

OTHER PUBLICATIONS

Marigold (30 Gals. Trash Bags), Distribution by Glencourt Inc., Walnut Creek, CA 94598–3592.

*Primary Examiner*—Ramon O. Ramirez
*Assistant Examiner*—Long Dinh Phan
*Attorney, Agent, or Firm*—Hughes, Multer & Schacht; Richard D. Multer

[57] ABSTRACT

Disposable covers for tray jacks and waste containers. These covers have an aesthetically pleasing segment which conceals the tray jack or container and a second, integral segment. In tray jack applications of the invention, the integral segment provides a receptacle for trash and other wastes. And, in container applications of the invention, the second, integral segment provides an inner liner for the container.

1 Claim, 3 Drawing Sheets

COVERS

RELATION TO ANOTHER APPLICATION

This application is a division of application Ser. No. 08/065,815 filed 21 May 1993 now U.S. Pat. No. 5,462,103.

TECHNICAL FIELD OF THE INVENTION

Covers which both shield an unsightly structure and provide a waste receptacle or an inner liner for a waste container.

BACKGROUND OF THE INVENTION

U.S. Pat. No. 5,165, 633 issued 24 Nov. 1992 to Effa et al. for COVERS discloses a novel, decorative, and aesthetically pleasing cover for the collapsible tray jacks employed in restaurants, banquet rooms, and other settings to facilitate the transfer of food and beverages and dirty dishes. In the settings in which tray jacks are employed, considerable volumes of trash, garbage, and other waste are generated. Consequently, it would be advantageous to have available a decorative tray cover which would also serve as a receptacle or container for this waste.

Also advantageous would be decorative, disposable liners so fabricated as to cover and make more aesthetically pleasing the waste paper baskets, trash and garbage cans, and other containers with which disposable liners are employed.

SUMMARY OF THE INVENTION

Covers of the character just described have now been invented and are disclosed herein. Generally speaking, these novel artifacts are of tube or baglike configuration with the usual, oppositely disposed open and closed ends. A decorative pattern or other, aesthetically pleasing appearance is provided on a segment of cover beginning at its open end and extending a distance equalling the height of the tray jack, container, or other support with which the cover is to be employed. The cover is installed by displacing it downwardly over the container or tray jack to conceal the latter. Then, the closed end segment of the cover is displaced downwardly through the opening defined by the crosspieces and flexible straps of a tray jack to form a waste-receiving pouch or receptacle.

To remove the cover or liner, its outer, decorative segment is peeled upwardly off of the supporting container or tray jack. If employed as a liner, the filled artifact is then removed from the associated container. In the case of a tray jack cover, the jack is simply lifted off the filled cover to remove the latter to a garbage bin or the like.

The novel covers of the present invention are inexpensive and easily installed and removed. At the same time, they solve important aesthetic problems by concealing the tray jacks or containers with which they are employed.

The objects, features, and advantages of the present invention will be apparent to the reader from the foregoing, the appended claims, and the ensuing detailed description and discussion of the invention as it proceeds in conjunction with the accompanying drawings.

DETAILED DESCRIPTION OF THE INVENTION

Figure 2:
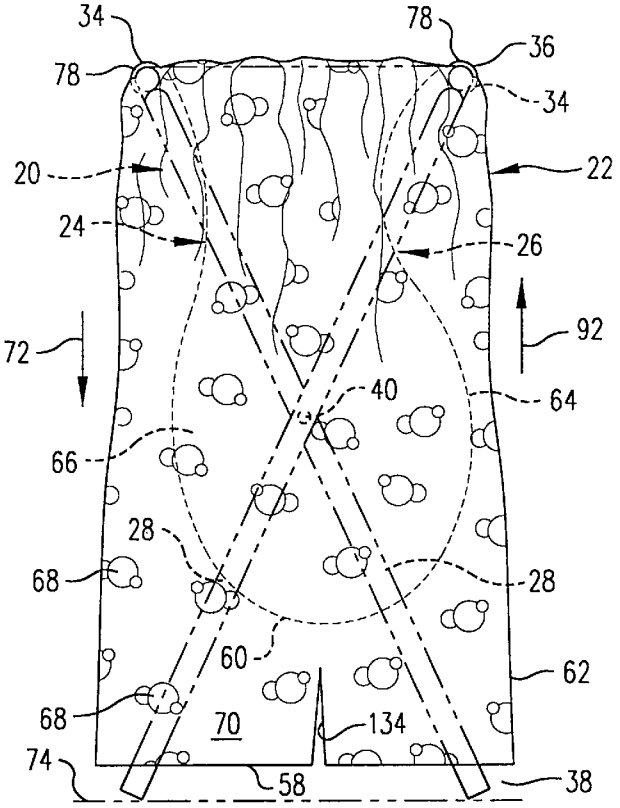
FIG. 2 is an end view of the covered tray jack.
Figure 1:
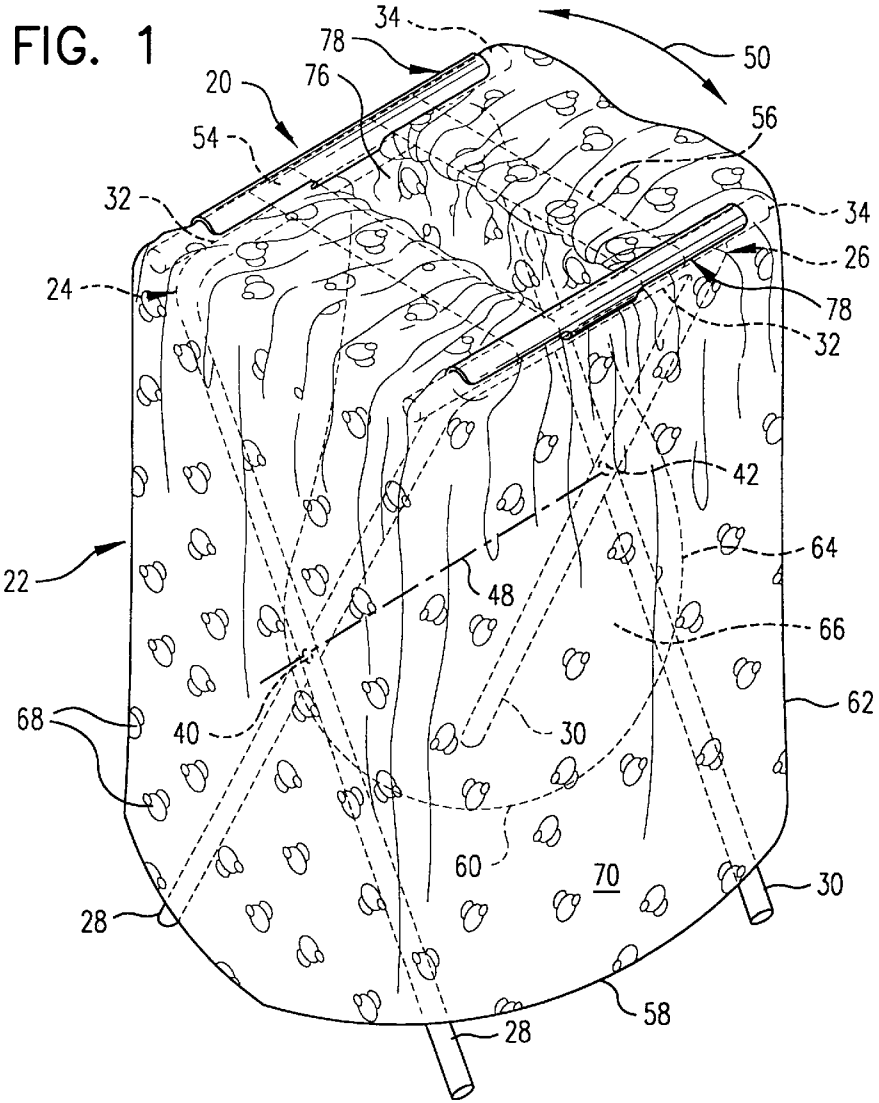
FIG. 1 is a perspective view of a tray jack so enveloped by a flexible cover embodying the principles of the present invention as to: (1) conceal the tray jack behind an aesthetically pleasing shield, and (2) provide a tray jack-supported, concealed receptacle for trash and other waste.

Referring now to the drawing, FIGS. 1 and 2 depict a tray jack 20 equipped with a cover 22 which is designed to: (1) hide the tray jack in the interest of providing a serving or busing station with an attractive appearance, even if a relatively unattractive tray jack is employed; and (2) provide a concealed receptacle for trash and other waste.

Tray jack 20 is of conventional construction. It includes two U-shaped components 24 and 26, each having a pair of parallel, spaced apart, vertically extending legs 28 and 30. These legs are topped by an integral, horizontal leg 32. An also horizontally extending crosspiece 34 spans, and is fixed to, each of the horizontal legs 32. Crosspieces 34 support a food service tray, busing container, or the like (not shown) when tray jack 20 is opened to the operative position shown in FIGS. 1 and 2.

Approximately midway between its upper and lower ends 36 and 38, the two legs 28 of tray jack 20 are fixed together at one end of the tray jack by a screw, rivet or other pivot member 40. The two jack legs 30 are similarly fixed together at the opposite end of the jack by a pivot member 42. Pivot members 40 and 42 are aligned along the same pivot axis 48.

The arrangement just described allows tray jack components or subassemblies 24 and 26 to be swung apart as suggested by arrow 50 in FIG. 1 to place tray jack 20 in the operational configuration shown in that figure and to be swung together to a collapsed, storing and transporting configuration.

In the operational configuration of tray jack 20 shown in FIG. 1, the relative movement of tray jack subassemblies 24 and 26 away from each other is limited to keep the jack in the illustrated, operational configuration by flexible straps 54 and 56. At one end, straps 54 and 56 are attached to the horizontal legs 32 of tray jack subassemblies 24. The opposite ends of straps 54 and 56 are attached to the horizontal leg 32 of tray jack subassembly 26. Thus, with straps 54 and 56 fully extended as shown in FIGS. 1 and 2, the horizontal legs 32 of subassemblies 24 and 26 and crosspieces 34 cannot move further apart than is shown in those figures.

The illustrated tray jack is constructed of light weight metal tubing as is a second, commercially available jack which has a different scheme that keeps the two subassemblies of that jack from spreading too far apart. The third, commercially available tray jack is similarly constructed but of turned wooden dowels rather than metal tubing.

Referring still to the drawing, cover 22 has a baglike configuration with opposite, open and closed ends 58 and 60. This cover will typically be fabricated from any of the flexible, sheetlike polymers conventionally employed in the manufacture of trash bags and trash can liners. However, this is not critical; and the bag can instead, if desired, be made from paper, cloth, or other material.

Cover 22 has a skirt-defining segment 62 which extends from the open end 58 of the cover toward its closed end 60. It also has an integral segment 64 which extends from skirt-defining segment 62 to the closed end 60 of the cover. With cover 22 assembled to tray jack 20, this integral segment 64 provides a receptacle 66 for trash and other wastes.

As discussed above, it is a feature of the present invention that cover 22 conceals tray jack 20 behind an aesthetically pleasing shield provided by the skirt-defining segment 62 of the cover. To that end, an aesthetically pleasing pattern of images 68 may be printed or otherwise provided on the exterior surface 70 of the skirt-defining cover segment 62. An endless variety of images including corporate logos, cartoon characters, thematic figures, and the like may be employed; and other techniques such as weaving may be utilized to generate the image or images. Other ways of providing an aesthetically pleasing appearance such as simply employing a cover with a tasteful color can also be used.

Cover 22 is associated with tray jack 20 by orienting it with the open end 58 of the cover facing downwardly and positioned above the tray jack. Then, cover 22 is displaced downwardly (in the arrow 72 direction) until the open end 58 of the cover reaches or approaches the level of the floor 74 or other tray jack support. This envelopes tray jack 20 with, and conceals it behind, the aesthetically pleasing, skirt-defining segment 62 of cover 22.

Installation of cover 22 is completed by displacing its receptacle-defining segment 64 downwardly through that opening 76 at the upper end 36 of tray jack 20 defined by crosspieces 34 and flexible straps 54 and 56 to create receptacle 66.

Although not essential, it is preferred that cover 22 then be positively affixed to tray jack 20. This, for example, keeps the cover from slipping and exposing tray jack 20 if relatively heavy waste is accumulated in receptacle 66 and segment 64 of the cover as a consequence shifts downwardly in the arrow 72 direction.

Figure 4:
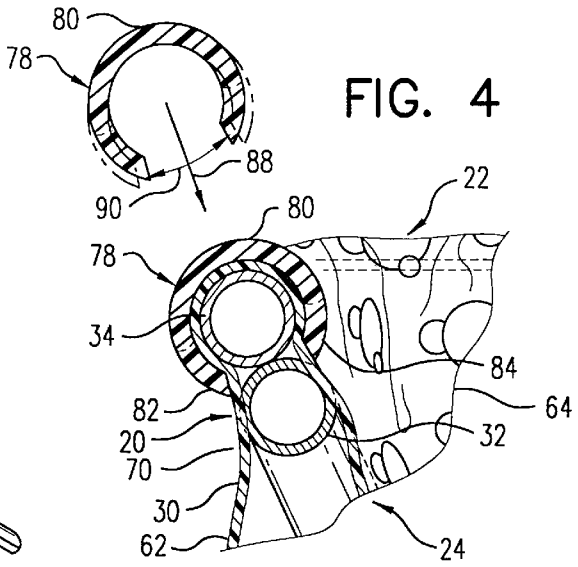
FIG. 4 is a section view showing how the clip is employed to clamp the cover to the tray jack.
Figure 3:
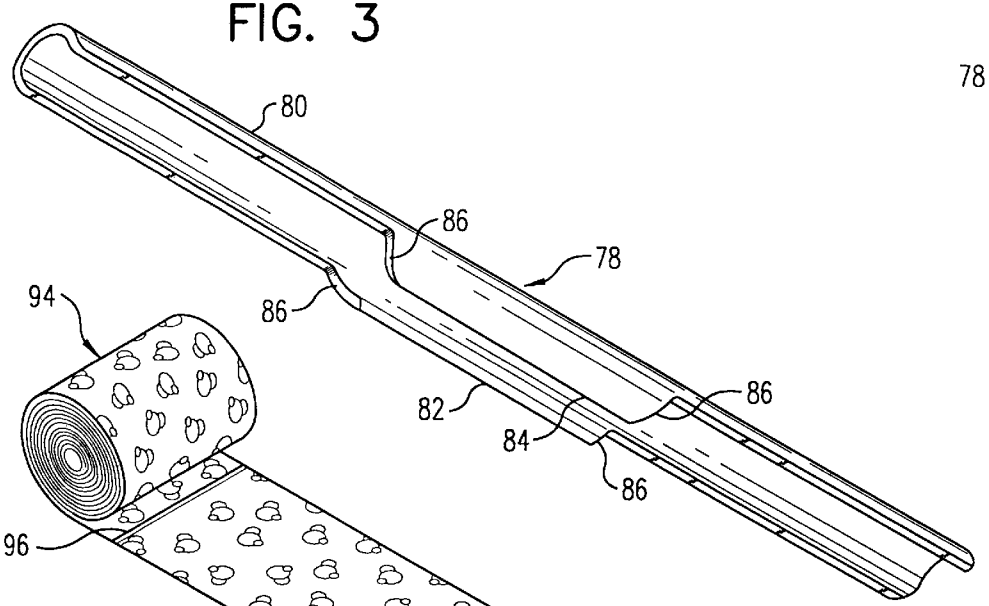
FIG. 3 is a perspective view of a clip employed to clamp the cover to the tray jack.

Cover 22 can be easily affixed to tray jack 20 after it has been installed in the manner discussed above with elongated clips of the character best illustrated in FIGS. 3 and 4 and identified by reference character 78. Each of these clips 78 has an elongated segment 80 with an arcuate cross-section. Integral legs 82 and 84 are located at the midpart of segment 80 and on opposite sides thereof. These legs are resiliently displaceable as suggested by the solid and dotted lines in FIG. 5, and they are configured as arcuate continuations of segment 80. The ends 86 of legs 82 and 84 are preferably tapered and rounded as shown in FIG. 4 so that the legs will not snag or hang up on cover 22, the clothing of a person handling them, etc.

Figure 5:
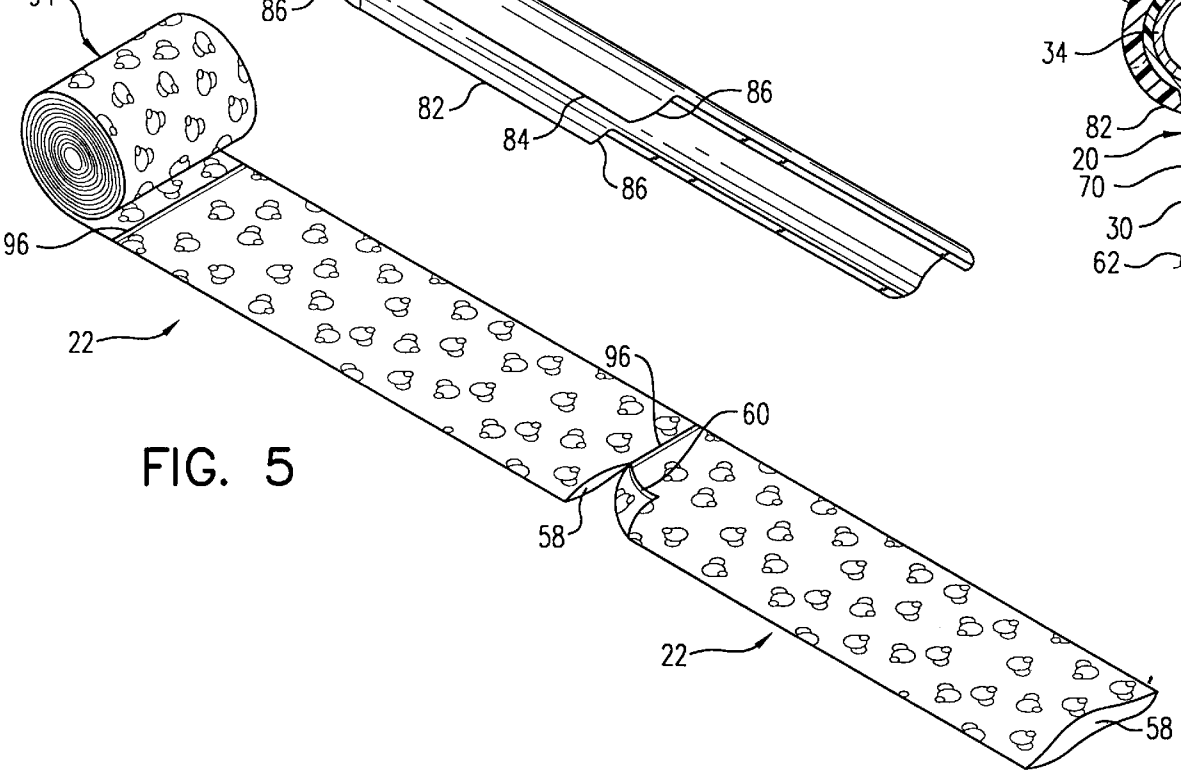
FIG. 5 is a pictorial view of an assemblage from which flexible, baglike, covers and liners embodying the principles of the present invention can be detached as needed.

As is best shown in FIG. 5, the cross-section of clip 78 matches or complements that of the crosspiece 34 at the upper end 36 of tray jack 20. Consequently, displacement of the clip 78 over crosspiece 34 in the arrow 88 direction (see FIG. 4) will spring the legs 82 and 84 of clip 78 apart as indicated by double-headed arrow 90, allowing the clip to be assembled to crosspiece 34. Thereafter, legs 82 and 84 restore to the solid line positions, clamping cover 22 against crosspiece 34 to hold it in place; i.e., in the relationship to tray jack 20 shown in FIGS. 1 and 2.

Cover 22 is as easily removed from tray jack 20 as it is assembled to that device. Removal is accomplished by first removing clip 78 and lowering the receptacle-defining segment 64 of cover 22 to floor 74 or allowing it to settle to that level. Next, the skirt-defining segment 62 of the cover is peeled upwardly (i.e., in the arrow 92 direction of FIG. 2) until it clears the upper end 36 of tray jack 20. Typically, although not necessarily, the open end 58 of cover 22 will then be closed with a twist tie or other conventional retainer (not shown). Then, the skirt-defining segment 62 of cover 22 may be pushed down through the opening 76 at the upper end 36 of tray jack 20 and the tray jack lifted away. The tray jack can then be folded up and stored and cover 22 with its contents taken to a refuse collection station. Alternatively, if the use of tray jack 20 is to be continued and receptacle 66 is not full, the tray jack 20 may simply be folded up with cover 22 still in place, moved to a different location, and there again opened to the operative, FIGS. 1 and 2 configuration.

Referring now to FIG. 5, covers 22 will typically be fabricated of a polymeric material or paper so that they will be inexpensive enough to be disposed of after use. Covers 22 of this character may conveniently be supplied in an assemblage such as the illustrated roll 94. This roll consists of covers 22 oriented in end-to-end relationship with the open end 58 of one bag adjacent the closed end 60 of the next bag on the roll. A transversely extending row 96 of perforations or the equivalent is provided at each closed end, open end juncture to facilitate the separation of covers 22 from roll 94.

Figure 6:
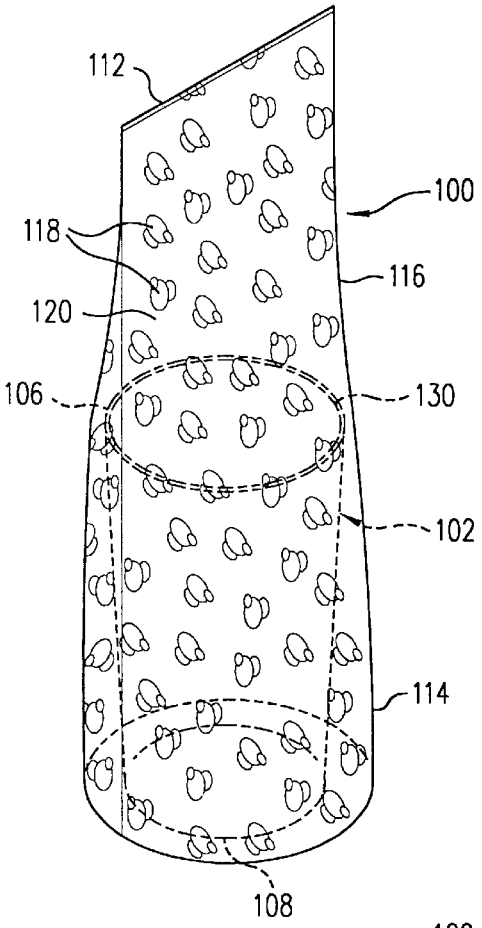
FIG. 6 is a pictorial view showing a flexible cover embodying the principles of the present invention in the process of being assembled to a conventional waste container.
Figure 7:
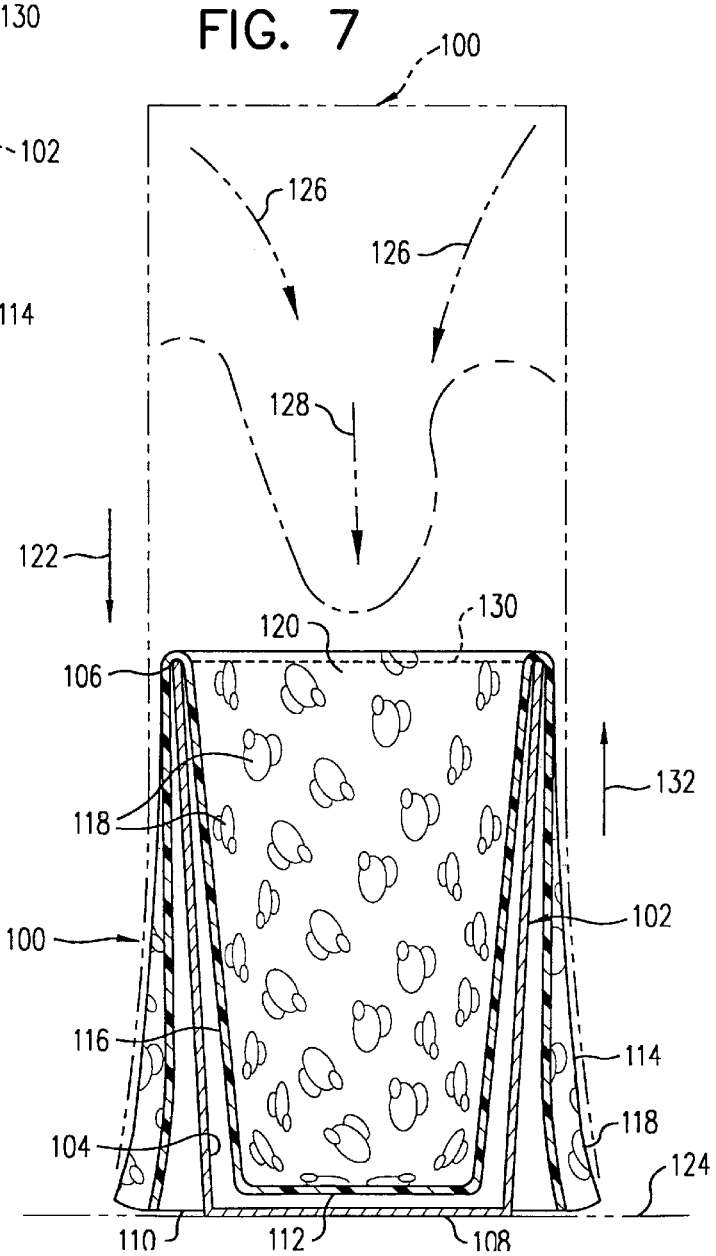
FIG. 7 is a vertical section of the completed assembly with the cover: (1 ) lining the container, and (2) concealing the container behind an aesthetically pleasing shield.

Referring again to the drawing, FIGS. 6 and 7 depict a refuse container 100 equipped with a cover 102 embodying the principles of the present invention to: (a) conceal the refuse container behind an aesthetically pleasing shield, and (b) line the inside 104 of the container and keep the latter from being soiled or otherwise contaminated.

The illustrated container 100 has an upper end 106 which is open for the receipt of trash, garbage, or other waste and a lower end 108. The lower end serves as a liner support and will typically be closed although it does not necessarily have to be if a liner is to be used.

Depending primarily upon its size, container 100 may be used as a garbage can, a waste paper basket, or as a receptacle for medical or other wastes.

Cover 102 has a baglike configuration with oppositely located, open and closed ends 110 and 112. It may be manufactured of any of the flexible materials discussed above in conjunction with tray jack cover 22.

Cover 102 has a skirt-defining and container-concealing segment 114 extending from the open end 110 of the cover toward the closed end 112 thereof and an integral, container liner-defining segment 116. That segment extends from the skirt-defining segment 114 to the closed end 112 of the cover.

In a manner corresponding to that discussed above in conjunction with tray jack cover 22, the skirt-defining segment 114 of the cover is given a pleasant color, or appropriate images 118 are printed or otherwise provided on the outer or exterior side 120 of cover 102 to provide an aesthetically pleasing appearance. The image or other appearance enhancement will preferably extend over liner-defining segment 116 as this segment is exposed to view in container-associated applications of the invention.

Cover 102 is installed on or associated with container 100 by orienting the cover with its open end 110 facing downwardly and at a level above the open, upper end 106 of the container. The cover is then slid or displaced downwardly in the arrow 122 direction over container 100 until the open end 110 of the cover approaches or reaches the floor 124 or other surface on which container 100 is supported. This shields container 100 behind the aesthetically pleasing, skirt-defining segment 114 of cover 102. Next, as is indicated by arrows 126 and 128 in FIG. 7, the integral, liner-defining segment 116 of cover 102 is displaced over the lip 130 at the open upper end 106 of container 100 and in the downward, arrow 122 direction. Completion of this step results in segment 116 lining the inner surface 104 of container 100 with the closed end 112 of the cover adjacent the lower end 108 of the container.

Removal of cover 102 is equally easy. The skirt-defining segment 114 of the container is peeled upwardly in the arrow 132 direction until segment 114 clears the upper, open end 106 of container 100. Then, cover 102 may be closed as with a twist tie or other conventional retainer to keep waste accumulated in the cover from escaping; and the cover and its contents are removed from container 100.

Like tray jack covers 22, container covers such as those just discussed may conveniently be supplied in the assembled, perforated-roll form illustrated in FIG. 5 and described above.

The features discussed above are significant and distinguish the novel covers disclosed herein from conventional trash can liners which, in any event, are not dimensioned in a manner which would allow them to be employed both as a liner and for purposes of concealment. Furthermore, conventional liners are more difficult to install as they must first be placed in the container, and then somehow held in place while the liner is trained down over the upper edge of the container. Furthermore, the manner in which they are installed would require that the inner side of a conventional liner be printed or otherwise provided with the aesthetically pleasing images employed by applicant. From a practical point-of-view, this cannot be done because the inks employed in printing on polymers, for example, make it impossible to then form a secure seal at the closed end of the liner.

The invention may be embodied in many forms without departing from the spirit or essential characteristics of the invention. For example, at its open end 22, a tray jack cover 22 may be slit as shown at 134 in FIG. 2 so that the skirt segment 62 will hang properly and not bunch or ride up the tray jack legs 28 and 30. The present embodiments are therefore to be considered in all respects as illustrative and not restrictive, the scope of the invention being indicated by the appended claims rather than by the foregoing description. All changes which come within the meaning and range of equivalency of the claims are therefore intended to be embraced therein.

I claim:

1. A method of so associating a container cover having oppositely disposed open and closed ends with a container as to both conceal and line said container;

said cover having a lower end, an open upper end, and an aesthetically pleasing design on an outer side of a skirt-defining segment extending from the open end of the container cover toward the closed end thereof;

said method comprising the steps of orienting the container cover with the open end thereof above the container and facing downwardly; displacing the component downwardly until the container is concealed by said skirt-defining segment; and thereafter displacing a closed end segment of the container cover over a lip at an upper open end of the container and downwardly a lower closed end of said container to line the container.

* * * * *